US007268730B2

(12) United States Patent
Park et al.

(10) Patent No.: US 7,268,730 B2
(45) Date of Patent: Sep. 11, 2007

(54) SMALL BROADBAND MONOPOLE ANTENNA HAVING PERPENDICULAR GROUND PLANE WITH ELECTROMAGNETICALLY COUPLED FEED

(75) Inventors: Ikmo Park, Yongin-si (KR); Jong-ho Jung, Yongin-si (KR); Young-min Moon, Seoul (KR); Seong-soo Lee, Suwon-si (KR); Young-eil Kim, Suwon-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 0 days.

(21) Appl. No.: 11/376,336

(22) Filed: Mar. 16, 2006

(65) Prior Publication Data

US 2006/0256015 A1 Nov. 16, 2006

(30) Foreign Application Priority Data

Mar. 16, 2005 (KR) ..... 10-2005-0021872

(51) Int. Cl.
*H01Q 1/38* (2006.01)

(52) U.S. Cl. ..... 343/700 MS; 343/846; 343/895

(58) Field of Classification Search ..... 343/700 MS, 343/846, 895
See application file for complete search history.

(56) References Cited

U.S. PATENT DOCUMENTS

| | | | | |
|---|---|---|---|---|
| 6,593,887 | B2 * | 7/2003 | Luk et al. | 343/700 MS |
| 2003/0107518 | A1 * | 6/2003 | Li et al. | 343/702 |
| 2005/0116867 | A1 * | 6/2005 | Park et al. | 343/725 |
| 2006/0170593 | A1 * | 8/2006 | Watts | 343/700 MS |

* cited by examiner

*Primary Examiner*—Tan Ho
(74) *Attorney, Agent, or Firm*—Sughrue Mion, PLLC

(57) ABSTRACT

A small broadband monopole antenna having a perpendicular ground plane with an electromagnetically coupled feed is provided. The small broadband monopole antenna may be realized as a small antenna having a size of $0.085\lambda_0 \times 0.085\lambda_0 \times 0.085\lambda_0$ by positioning a folded strip line under a shorted square disc. A resonance of the shorted square disc may be coupled to a resonance of the square folded strip line so as to form a wide bandwidth of about 36.6% of a central frequency of 2.313 GHz based on a VSWR≦2. Also, rectangular slits may be inserted into the perpendicular ground plane to improve a distortion of a radiation pattern that forms on the perpendicular ground plane so as to reduce a backward radiation by 3 dBi or more. The small broadband monopole antenna exhibits a forward radiation pattern similar to that of a general monopole antenna and has a gain of about 2.6 dBi within a bandwidth.

12 Claims, 18 Drawing Sheets

SMALL BROADBAND MONOPOLE ANTENNA HAVING PERPENDICULAR GROUND PLANE WITH ELECTROMAGNETICALLY COUPLED FEED

CROSS-REFERENCE TO RELATED APPLICATIONS

This application claims priority from Korean Patent Application No. 10-2005-0021872 filed on Mar. 16, 2005 in the Korean Intellectual Property Office, the entire disclosure of which is incorporated herein by reference.

BACKGROUND OF THE INVENTION

1. Field of the Invention

Apparatuses consistent with the present invention relate to a small disc-loaded monopole antenna in which bandwidth is expanded by electromagnetic coupling of a shorted square disc that is coupled to a perpendicular ground plane with a folded strip line feed.

2. Description of the Related Art

With recent increases in the development of functions for mobile communications devices, movies or TV can be viewed through mobile communication terminals. Also, as additional functionality such as digital camera and playback of audio files, such as MP3 files, are added to the mobile communication terminals, the mobile communication terminals have become communication instruments as well as instruments which are utilized for leisure. Also, as multi-band, multi-functional communication terminals such as personal digital assistants (PDAs) that are capable of simultaneously using mobile communication functions and wireless local area network (WLAN) functions are developed, small, broadband antennas having gain characteristics are required which are capable of operating in several communication bands.

Monopole antennas and planar inverted F antennas (PIFAs) have been mainly studied as small internal antennas to be applied to currently used terminals. The PIFAs have maximum gains in directions that are perpendicular to planes of the PIFAs. Thus, in a case where mobile communication systems receive signals from unspecified directions, performances of the mobile communication systems such as sensitivities of telephonic communications, transmission speeds of data, or the like may vary greatly with orientation of the PIFAs. [For detailed contents of these antennas, refer to: Y. B. Kwon, J. I. Moon, and S. O. Park, "An internal triple-band inverted-F antenna," *IEEE Antennas Wireless Propagat. Lett.*, vol. 2, pp. 341-344, 2003; M. F. Abedin and M. Ali, "Modifying the ground plane and its effect on planar inverted-F antenna (PIFAs) for mobile phone handsets," *IEEE Antennas Wireless Propagat. Lett.*, vol. 2, pp. 226-229, 2003; and J. Fuhl, P. Nowak, and E. Bonek, "Improved internal antenna for hand-held terminals," *Electron. Lett.*, vol. 30, no. 22, pp. 1816-1818, October 1994.]

Therefore, monopole antennas having omni-directional radiation patterns are suitable for mobile communication terminals. However, since such a monopole antenna has a resonance length of 0.25λ, the monopole antenna must have a small structure to be used as an internal antenna. A method of transforming the monopole antenna into a folded type antenna is most widely used so as to make the monopole antenna small. [For detailed contents of these antennas, refer to: F. S. Chang, S. H. Yeh, and K. L. Wong, "Planar monopole in wrapped structure for low-profile GSM/DCS mobile phone antenna," *Electron. Lett.*, vol. 38, no. 11, pp. 499-500, May 2002; P. L. Teng and K. L. Wong, "Planar monopole folded into a compact structure for very-low-profile multi-band mobile phone antenna," *Microwave Opt. Technol. Lett.*, vol. 33, no. 1, pp. 22-25, April 2002; C. Y. Chiu, P. L. Teng, and K. L. Wong, "Shorted, folded planar monopole antenna for dual-band mobile phone," *Electron. Lett.*, vol. 39, no. 18, pp. 1301-1302, September 2003; B. Sun, Q. Liu, and H. Xie, "Compact monopole antenna for GSM/DCS operation of mobile handsets," *Electron. Lett.*, vol. 39, no. 22, pp. 1562-1563, October 2003; and K. L. Wong, *Planar Antennas for Wireless Communications*. New York: Wiley, 2003, pp. 26-71.]

Strip lines may be meandered, i.e., folded, so as to reduce physical sizes of antennas. However, bandwidths of the antennas are reduced. Thus, folded monopole antennas are mainly used as dual-band antennas by connecting monopoles that have different resonance lengths on feed lines. In another method of making monopole antennas compact, folded, shorted planar monopoles and feed patches are fed using an electromagnetic coupling force. [Refer to S. H. Yeh, Y. Y. Chen, and K. L. Wong, "A low-profile, bent and shorted planar monopole antenna with reduced backward radiation for mobile phones," *Microwave Opt. Technol. Lett.*, vol. 33, no. 2, pp. 146-147, April 2002.] A height of such a structure may be reduced to 0.1λ of a central frequency. However, a bandwidth is less than or equal to 10% of the central frequency.

Also, Δ-type multi-folded tapered strip lines have been recently suggested so as to reduce heights of antennas. [Refer to I. F. Chen and C. M. Chiang, "Multi-folded tapered monopole antenna for wideband mobile handset applications," *Electron. Lett.*, vol. 40, no. 10, pp. 577-578, May 2004.] In this structure, a height of an antenna is 0.09λ of a central frequency and a bandwidth of 13% of the central frequency. However, heights of the above-described monopole antennas can be reduced. Thus, the monopole antennas can be used as internal antennas. However, bandwidths of the monopole antennas are too narrow to be applied to wide-band communications.

SUMMARY OF THE INVENTION

Accordingly, an aspect of the present invention provides a small broadband monopole antenna having a perpendicular ground plane with a bandwidth that is expanded by electromagnetic coupling of a shorted square disc connected to a perpendicular ground plane with a folded strip line feed.

Another aspect of the present general inventive concept is to provide a small broadband monopole antenna having a perpendicular ground plane with an electromagnetically coupled feed by which rectangular slits can be inserted into the perpendicular plane to reduce a distortion of a radiation pattern caused by an effect of a return current formed on the perpendicular plane so as to vary a distribution of the return current on the perpendicular ground plane.

According to an aspect of the present invention, there is provided a monopole antenna, including a shorted patch, a strip line probe including a predetermined length that is electromagnetically coupled to the shorted patch, and a ground plane that is perpendicular to the shorted patch and the strip line probe, wherein a serial resonance of the strip line is coupled to a parallel resonance of the shorted patch.

The strip line probe may be fed by a microstrip line of a predetermined diameter that is disposed on a first surface of a second dielectric substrate, and the shorted patch may be coupled to an upper end of the ground plane, which is disposed on second surface of the second dielectric substrate that is opposed to the first surface, through a shorted pin, so as to position the ground plane perpendicular to the strip line probe and the shorted patch.

The second dielectric substrate may be perpendicular to the strip line probe and the shorted patch.

The monopole antenna may further include: rectangular first and second slits that are symmetrically disposed at a predetermined perpendicular distance from left and right upper ends, respectively, of the ground plane, which is perpendicular to shorted patch and the strip line probe.

The first and second slits may vary a flow of a return current on the ground plane so as to minimize an effect of a radiation of the ground plane.

The first and second slits may reduce a backward radiation toward the ground plane so as to improve a gain in a forward direction of the monopole antenna.

The shorted patch may operate as a monopole having a capacitance component, and the strip feed line probe may operate as a monopole having an inductance component. Here, the capacitance component of the shorted patch may be compensated by the inductance component of the strip feed line probe so as to expand the frequency bandwidth of the monopole antenna.

A resonance of the strip line probe and a resonance of the shorted patch may be produced at different frequencies so as to generate a dual band.

The strip line probe may have a spiral shape, a helix shape, or a folded shape that is realized by folding a strip line.

The monopole antenna may further include: a first dielectric substrate disposed between the shorted patch and the strip line probe.

BRIEF DESCRIPTION OF THE DRAWINGS

The above and other aspects of the present invention will be more apparent by describing certain exemplary embodiments of the present invention with reference to the accompanying drawings, in which.

DETAILED DESCRIPTION OF THE EXEMPLARY EMBODIMENTS OF THE INVENTION

Figure 1A:
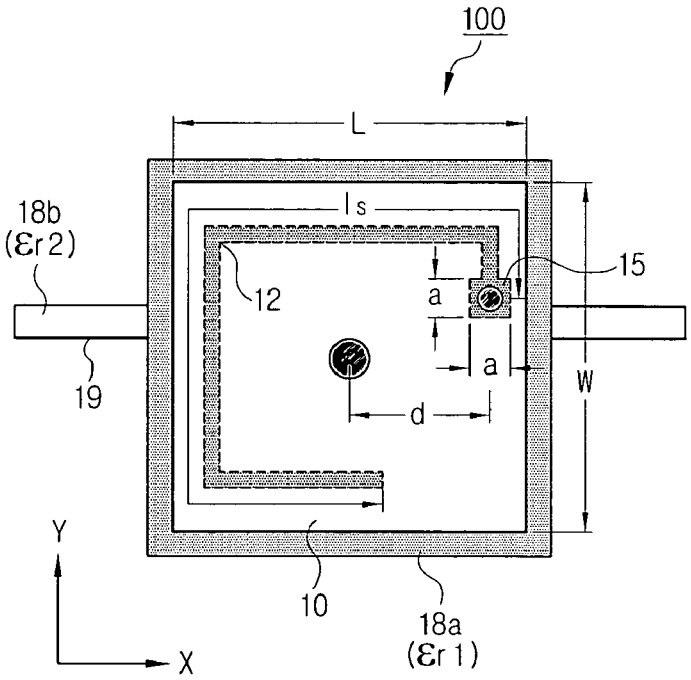
FIGS. 1A, 1B, and 1C are respectively a plan view, a side view, and a perspective of a small broadband monopole antenna having a perpendicular ground plane with an electromagnetically coupled feed according to an exemplary embodiment of the present invention.

Certain exemplary embodiments of the present invention will be described in greater detail with reference to the accompanying drawings.

In the following description, same drawing reference numerals are used for the same elements even in different drawings. The matters defined in the description such as a detailed construction and elements are nothing but the ones provided to assist in a comprehensive understanding of the invention. Thus, it is apparent that the present invention can be carried out without those defined matters. Also, well-known functions or constructions are not described in detail since they would obscure the description of the exemplary embodiments in unnecessary detail.

Figure 1B:
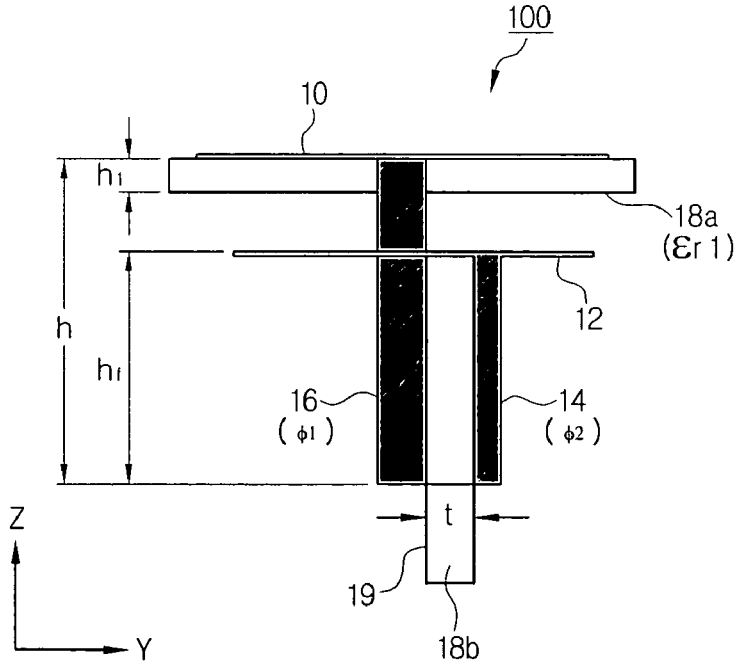
Figure 1C:
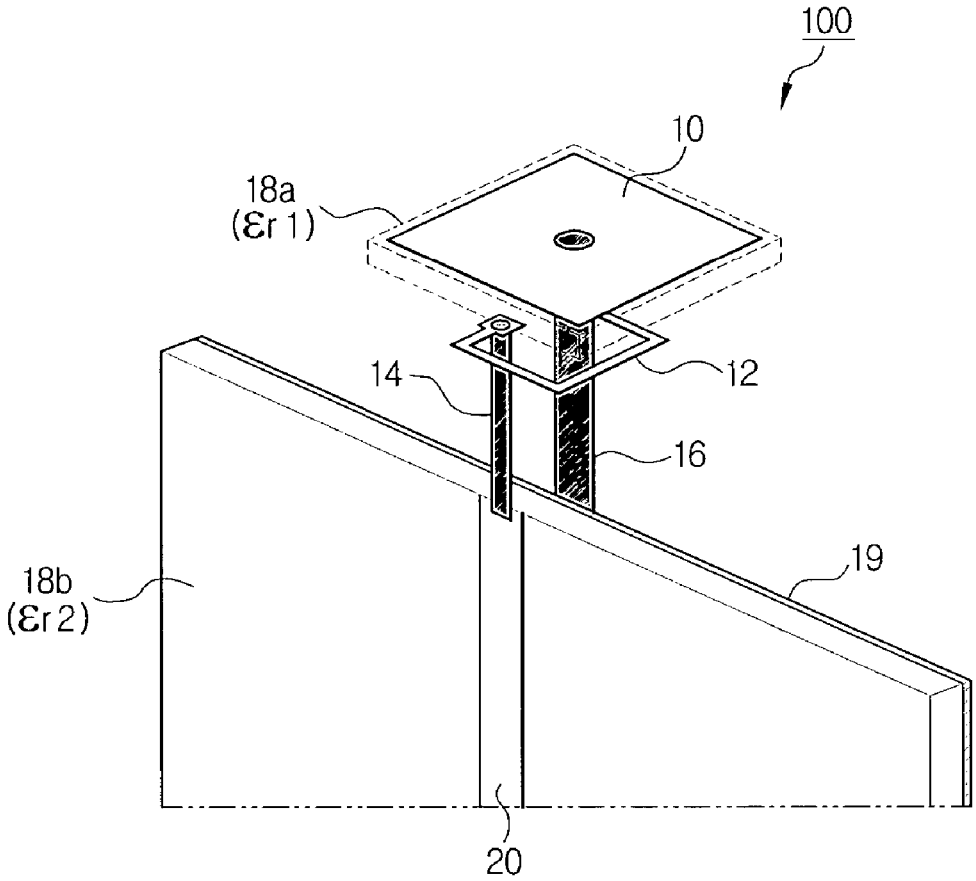

FIGS. 1A, 1B, and 1C are respectively a plan view, a side view, and a perspective view illustrating a structure of a small broadband monopole antenna having a perpendicular plane with an electromagnetically coupled feed according to an exemplary embodiment of the present invention. Referring to FIGS. 1A through 1C, a ground plane 19 is positioned on an x-z plane and may have a rectangular shape with a length A of 80 mm and a width B of 90 mm. A second dielectric substrate 18*b* used on the ground plane 19 may be an RO 4003 substrate that has a relative permittivity $\epsilon_{r2}$ of 3.38 and a thickness t of 0.508 mm. An antenna 100 is connected to an end of the ground plane 19 so as to be perpendicular to the ground plane 19 in a z-axis direction.

A square disc 10 has a length L, a width W, and a height h, and a central portion connected to the ground plane 19 through a shorted pin 16 having a diameter $\phi$1. To reduce a size of the square disc 10 that is shorted, a first dielectric substrate 18*a* having a high permittivity is inserted into a lower surface of the square disc 10. The first dielectric substrate 18*a* may be an RT/Duroid 6010 substrate having a relative permittivity $\epsilon_{r1}$ of 10.2 and a thickness h1 of 1.27 mm.

A square strip line 12 has a folded shape, a total length ls, and a width $w_s$, and is connected to a microstrip feed line 20 of the ground plane through a probe 14 having a diameter of $\phi$2 at a height $h_f$ from an end of the ground plane.

Here, the width of the square strip line 12 is generally narrower than the diameter of the probe 14. Thus, both ends of the square strip line 12 are connected to each other using a small square patch 15 having a length a. The shorted pin 16 of the square disc 10 and the probe 14 perpendicular to the square strip line 12 are electromagnetically coupled to each other at a distance of d. The microstrip feed line 20 is used to feed the antenna 100 and has a width wf of 1.2 mm so as to have a characteristic impedance of 50 Ω.

The shorted, square disc 10 improves an impedance matching characteristic of a feed of the square strip line 12 and produces a resonance due to an effect of electromagnetic coupling from a feed line. Thus, the square disc 10, which has a capacitance component, operates as a monopole antenna. The shorted, square disc 10 is equivalent to a parallel RLC resonance circuit including a capacitor, the square disc 10, and the shorted pin 16 having an inductance component. Therefore, in a square strip line feed antenna, the shorted, square disc 10 electromagnetically couples the feed of the square strip line 12 to the square strip line 12 to produce a parallel resonance so as to operate as a monopole antenna. The monopole antenna can adjust a resonance of the monopole antenna by adjusting the feed of the strip line 12 and an inductance and the capacitance of the shorted, square disc 10. As a result, the monopole antenna can be designed so as to have a broad single or dual band characteristic using the resonance characteristic. As shown in FIGS. 1A through 1C, a strip feed line may be folded. However, the strip feed line is not limited to such a configuration. For instance, the strip feed line may be realized in various forms such as a helix form, a spiral form, and the like.

In the antenna structures shown in FIGS. 1A through 1C, a strip line feed operating as a serial RLC resonance circuit is electromagnetically coupled to a shorted, square disc operating as a parallel RLC resonance circuit. Thus, the antenna structures have the same operation principle.

A method of designing a monopole antenna and a characteristic of the monopole antenna according to an exemplary embodiment of the present invention will now be described. An EM simulation may be performed on a finite ground using a high frequency structure simulator (HFSS) manufactured by Ansoft, which is based on a finite element method (FEM), to design and fabricate a monopole antenna.

An electromagnetically coupled feed disc-folded monopole antenna basically has a structure in which a shorted square disc monopole antenna and a folded strip line feed monopole antenna respectively having resonance frequencies are electromagnetically coupled to each other. A diameter $\phi$1 of a shorted pin, a length $l_S$ of a folded strip line, a height $h_f$ of a feed probe, and the like vary a resonance frequency of an antenna to affect a bandwidth. Thus, a distance between a shorted square disc monopole and a folded strip line feed monopole affects an electromagnetic coupling strength between the shorted square disc monopole and the folded strip line feed monopole.

In general, the shorted square disc monopole determines a low resonance frequency, and the folded strip line feed monopole determines a high resonance frequency. If the low and high resonance frequencies are close, a broadband characteristic shows. If the low and high frequencies are distant, a dual resonance characteristic shows.

Figure 2:
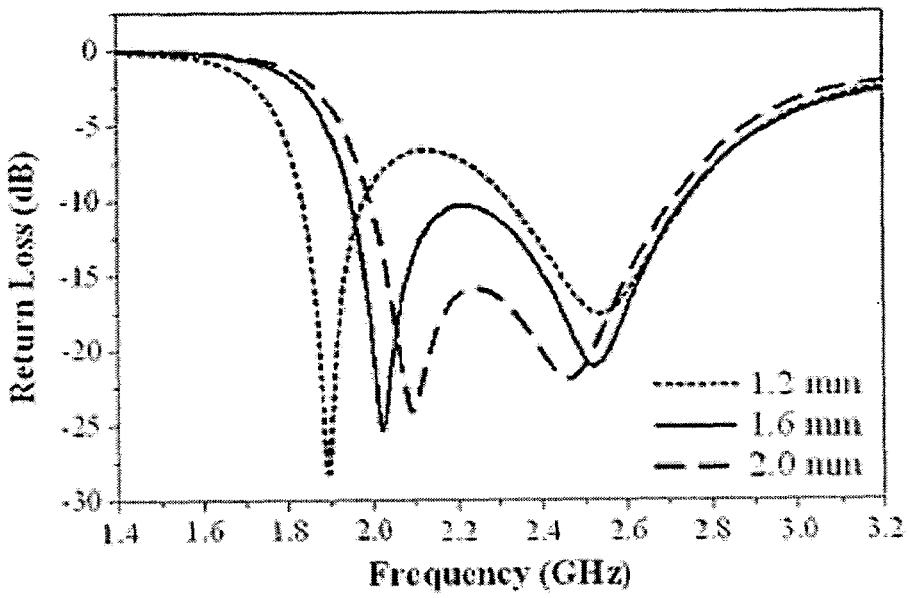
FIG. 2 is a graph illustrating a return loss with respect to a variation in a diameter of a shorted pin of a disc.

FIG. 2 is a graph illustrating a return loss with respect to a variation in a diameter of a shorted pin of a disc. It is supposed that a size L(=W) of a square disc is 11.0 mm, and a height h of the square disc from a ground plane is 11.0 mm. Also, it is-supposed that a folded strip line feed has a length $l_s$ of 21.9 mm and a width of 0.3 mm, and a probe coupled to the folded strip line feed has a diameter $\phi$2 of 0.86 mm and a height $h_f$ of 8.4 mm.

Referring to FIG. 2, when the diameter of the shorted pin is 1.2 mm, a low resonance frequency determined by a shorted square disc monopole is 1.89 GHz. However, when the diameter of the shorted pin is increased to 1.6 mm and 2.0 mm, the low resonance frequency is increased to 2.02 GHz and 2.11 GHz.

A high resonance frequency that is determined by the length of the folded strip line is lowered from 2.53 GHz to 2.47 GHz with an increase in the diameter of the shorted pin. However, the high resonance frequency hardly varies compared to the low resonance frequency. Also, if the low resonance frequency is gradually increased with the increase in the diameter of the shorted pin, the high and low resonance frequencies are coupled so as to improve a matching characteristic. However, the bandwidth of the monopole antenna is reduced.

Figure 3:
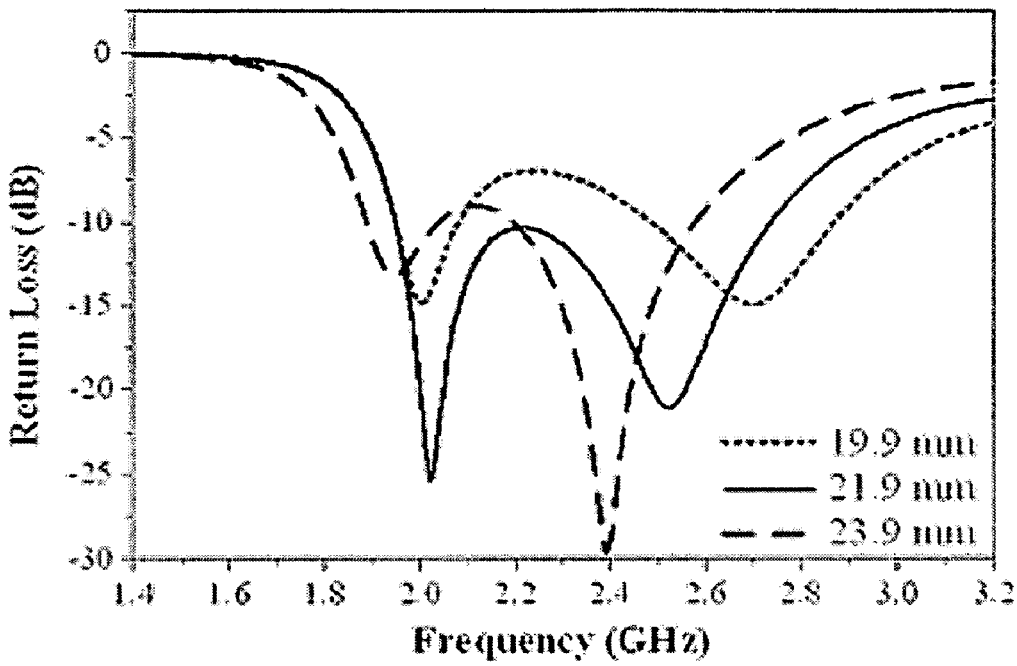
FIG. 3 is a graph illustrating a return loss with respect to a variation in a length $l_s$ of a folded feed line.

FIG. 3 is a graph illustrating a variation in a return loss of an antenna with respect to a variation in the length $l_S$ of a folded feed line. Other design parameters except the length ls of the folded feed line were set to be the same as those described with reference to FIG. 2 to compare the characteristics with respect to parameters. Referring to FIG. 3, if the length ls of the folded feed line is changed from 19.9 mm to 23.9 mm, i.e., by 4.0 mm, a resonance length of a folded strip line feed monopole is increased so as to lower a resonance frequency. Describing the return loss, a high resonance frequency is lowered from 2.70 GHz to 2.39 GHz with the increase in the folded strip line. However, when the length of the folded strip line is 19.9 mm and 21.9 mm, a low resonance frequency determined by a shorted square disc monopole is 2.0 GHz. When the length of the folded strip line is 23.9 mm, the low resonance frequency is about 1.95 GHz. Thus, the low resonance frequency is almost uniformly maintained regardless of the variation in the length of the folded strip line.

Figure 4:
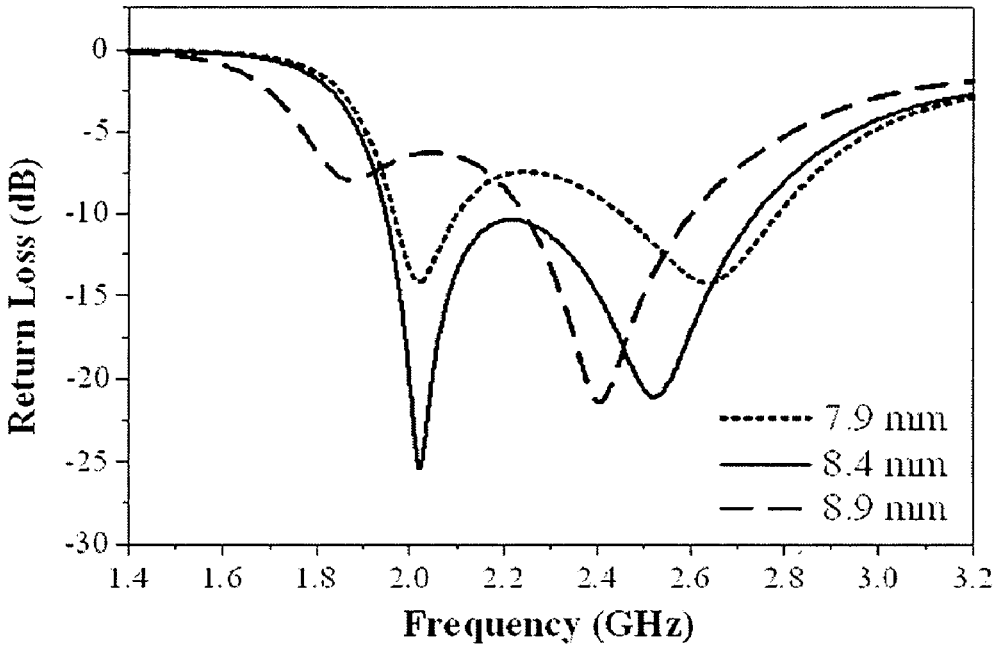
FIG. 4 is a graph illustrating a return loss with respect to a variation in a height of a folded strip line.

FIG. 4 is a graph illustrating a return loss with respect to a variation in a height of a folded strip line. The variation in the height of the folded strip line causes a variation in a length of a probe. Thus, the variation in the height of the folded strip line affects a resonance frequency of a strip line feed monopole like the variation in the length of the folded strip line. Since the length of the probe is increased with the increase in the height of the folded strip line, a high resonance frequency is lowered from 2.635 GHz to 2.405 GHz. When the length of the probe is 7.9 mm and 8.4 mm, a low resonance frequency is maintained at about 2.0 GHz. However, when the length of the probe is 8.9 mm, the low resonance frequency is lowered to 1.88 GHz. Thus, matching is not adequately achieved. Comparing the results shown in FIGS. 3 and 4, the variation in the resonance length of the folded strip line feed monopole affect the high resonance frequency of a dual resonance frequency. Here, the variation in the resonance frequency caused by a vertical length of the probe is greater than the variation in the resonance frequency caused by a horizontal length of the folded strip line.

Figure 5A:
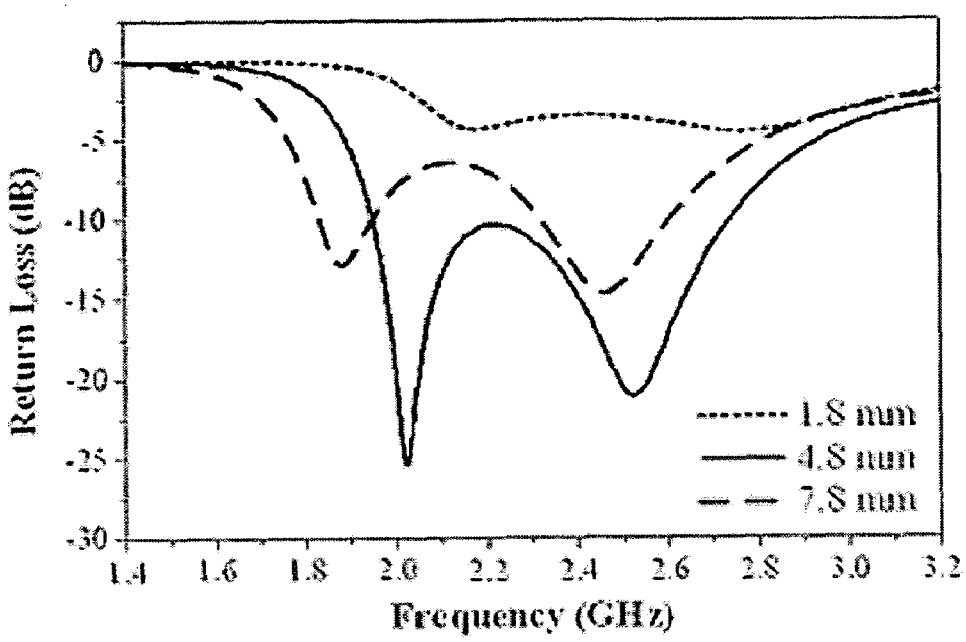
FIGS. 5A and 5B are graphs illustrating variations in a return loss of an antenna with respect to variations in a gap between a shorted pin and a probe.

FIG. 5A is a graph illustrating a variation in a characteristic of an antenna with respect to a variation in a distance between a shorted pin and a probe. The distance between the shorted pin and the probe affects an electromagnetic coupling force of two monopoles.

Describing a return loss shown in FIG. 5A, as the distance between the shorted pin and the probe is increased from 1.8 mm to 7.8 mm, a resonance frequency of the antenna is substantially lowered. Also, when the distance between the shorted pin and the probe is 1.8 mm, the antenna does not exhibit an adequate matching characteristic. However, when the distance between the shorted pin and the probe is increased to 4.8 mm, the matching characteristic is improved so as to obtain a wide bandwidth. Further, when the distance between the shorted pin and the probe is increased from 4.8 mm to 7.8 mm, the return loss characteristic of the antenna is deteriorated.

Figure 5B:
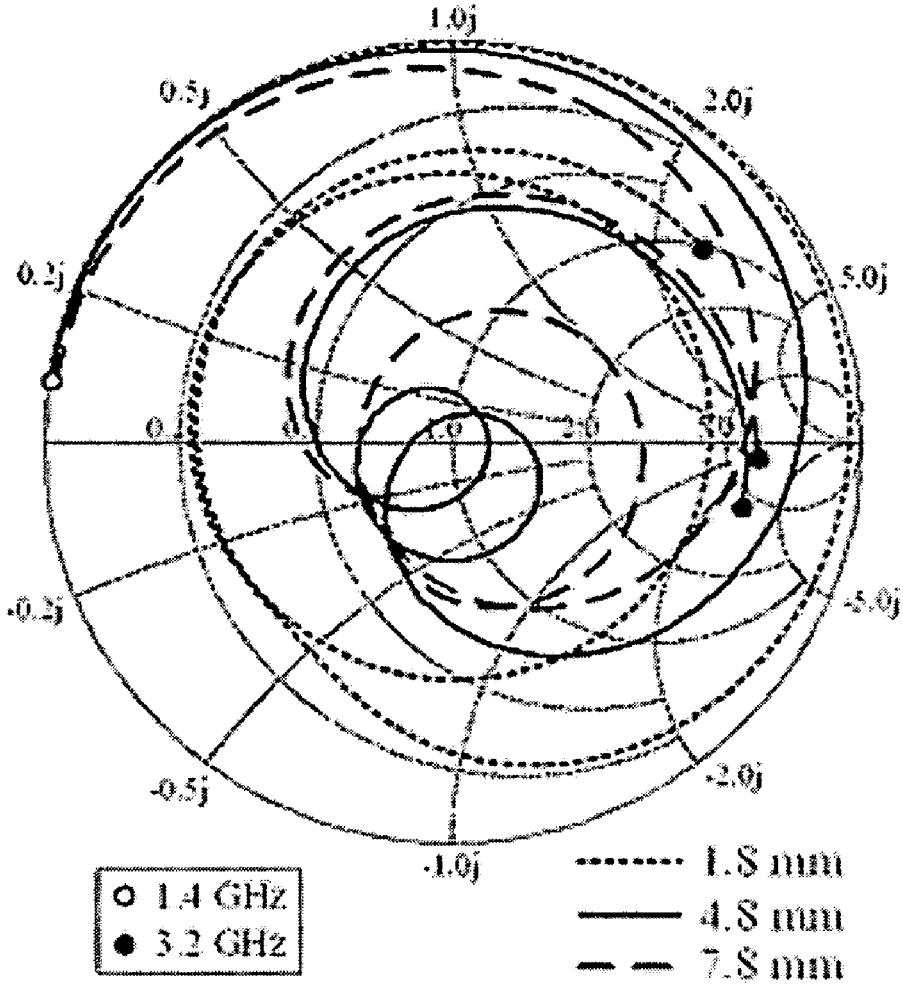

Describing a variation in an impedance characteristic shown in FIG. 5B, when the distance between the shorted pin and the probe is 1.8 mm, two monopoles are electromagnetically over-coupled. Thus, an impedance orbit deviates from a matching area. When the distance between the shorted pin and the probe is 4.8 mm, the two monopoles are electromagnetically critically coupled. Thus, the impedance orbit is positioned in the matching area. Here, the antenna has the broadest bandwidth. However, when the distance between the shorted pin and the probe is 7.8 mm, the two monopoles are electromagnetically under-coupled. Thus, the impedance orbit deviates from the matching area.

Figure 6:
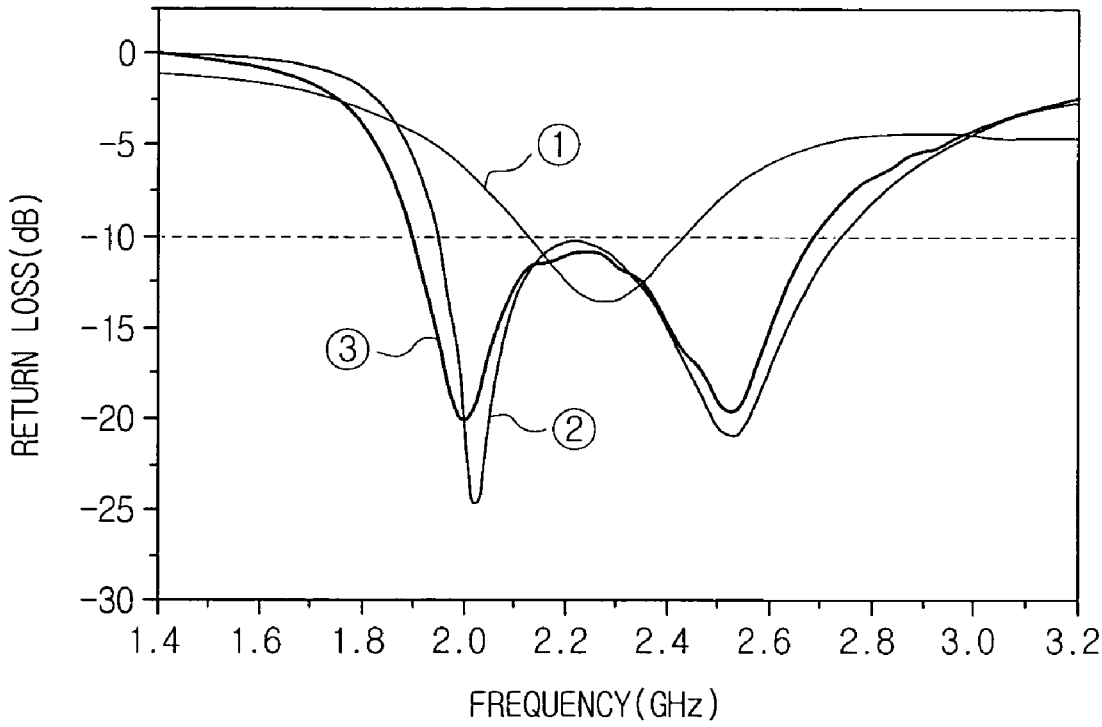
FIG. 6 is a graph illustrating variations in return losses of the small broadband monopole antenna shown in FIG. 1 and a conventional monopole antenna.

FIG. 6 is a graph illustrating variations in return losses in the small broadband antenna shown in FIG. 1 and the conventional monopole antenna. The graph shown in FIG. 6 illustrates return losses computed and measured in an optimized antenna based on the variations in the characteristics with respect to the above-described design parameters. Table 1 below shows the design parameters of the optimized antenna.

TABLE 1

| | Design Parameter | Length (mm) |
|---|---|---|
| Shorted Disc | L | 11.0 |
| | W | 11.0 |
| | H | 11.0 |
| | $H_1$ | 1.27 |
| | $\Phi_1$ | 1.6 |
| Square Folded Strip Line Feed | $l_s$ | 21.9 |
| | $w_s$ | 0.3 |
| | A | 1.4 |
| | D | 4.8 |
| | $h_f$ | 8.4 |
| | $\Phi_2$ | 0.86 |

In a conventional probe feed square disc-loaded monopole antenna, a feed probe is connected to a center of a square disc. The square disc has the same size as a disc of an antenna according to an exemplary embodiment of the present invention. The square disc and a 50 Ω line of a ground plane are fed using the feed probe having a diameter of 1.6 mm. A permittivity and a thickness of a substrate used for the square disc and a size of the ground plane are also identical to those of the antenna according to an exemplary embodiment of the present invention.

In the case of the conventional probe feed square disc-loaded monopole antenna, a computed bandwidth (shown with a curve ①) is about 13.16% of a central frequency of 2.28 GHz from 2.13 GHz to 2.43 GHz based on a voltage standing wave ratio (VSWR)≦2. A computed bandwidth of the antenna according to an exemplary embodiment of the present invention (shown with a curve ②) is about 33.84% of a central frequency of 2.343 from 1.947 GHz to 2.74 GHz. A bandwidth (shown with a curve ③) of an antenna fabricated and measured is about 34.13% of a central frequency of 2.291 GHz from 1.90 GHz to 2.682 GHz. Compared to the result of the conventional probe feed square disc-loaded monopole structure, the antenna in accordance with an exemplary embodiment of the present invention forms a bandwidth that is expanded approximately 2.6 times.

Figure 7A:
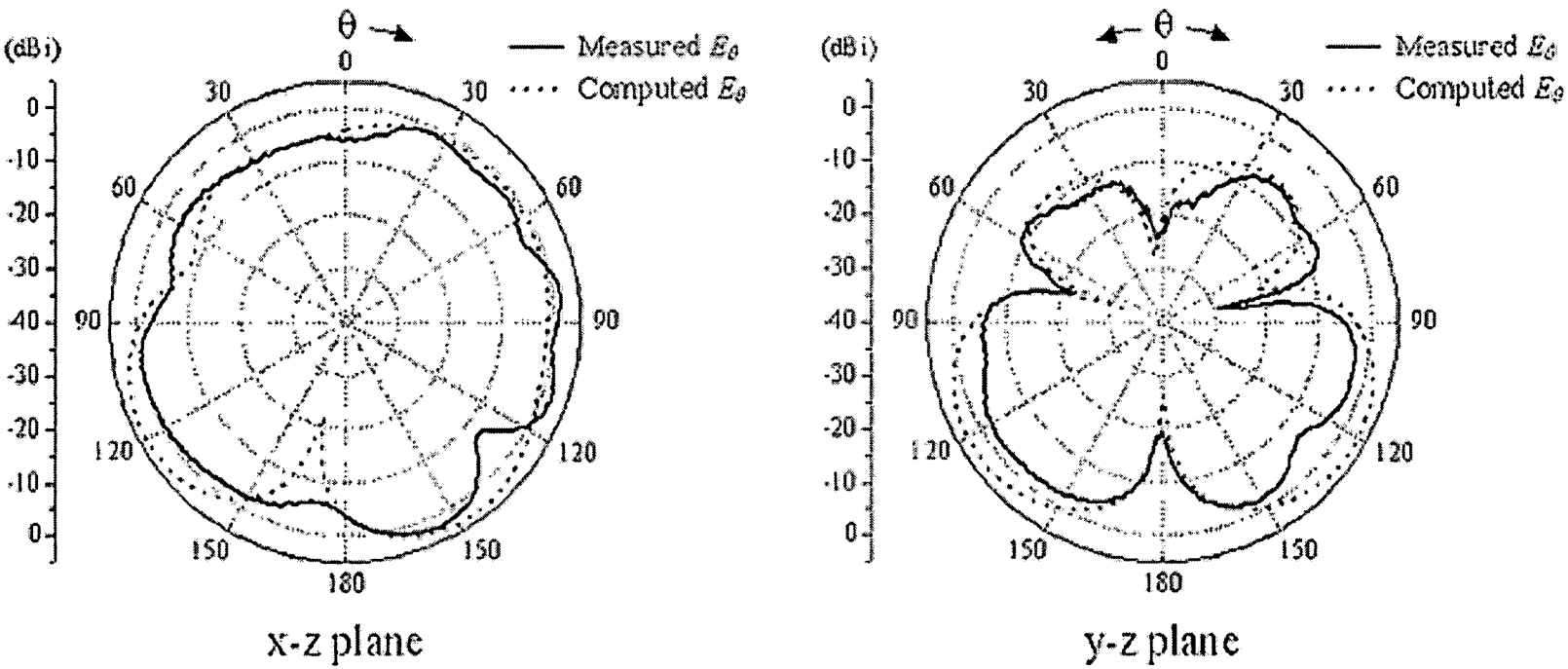
FIGS. 7A through 7C are graphs illustrating radiation patterns $E_\theta$ of an antenna within a bandwidth.
Figure 7B:
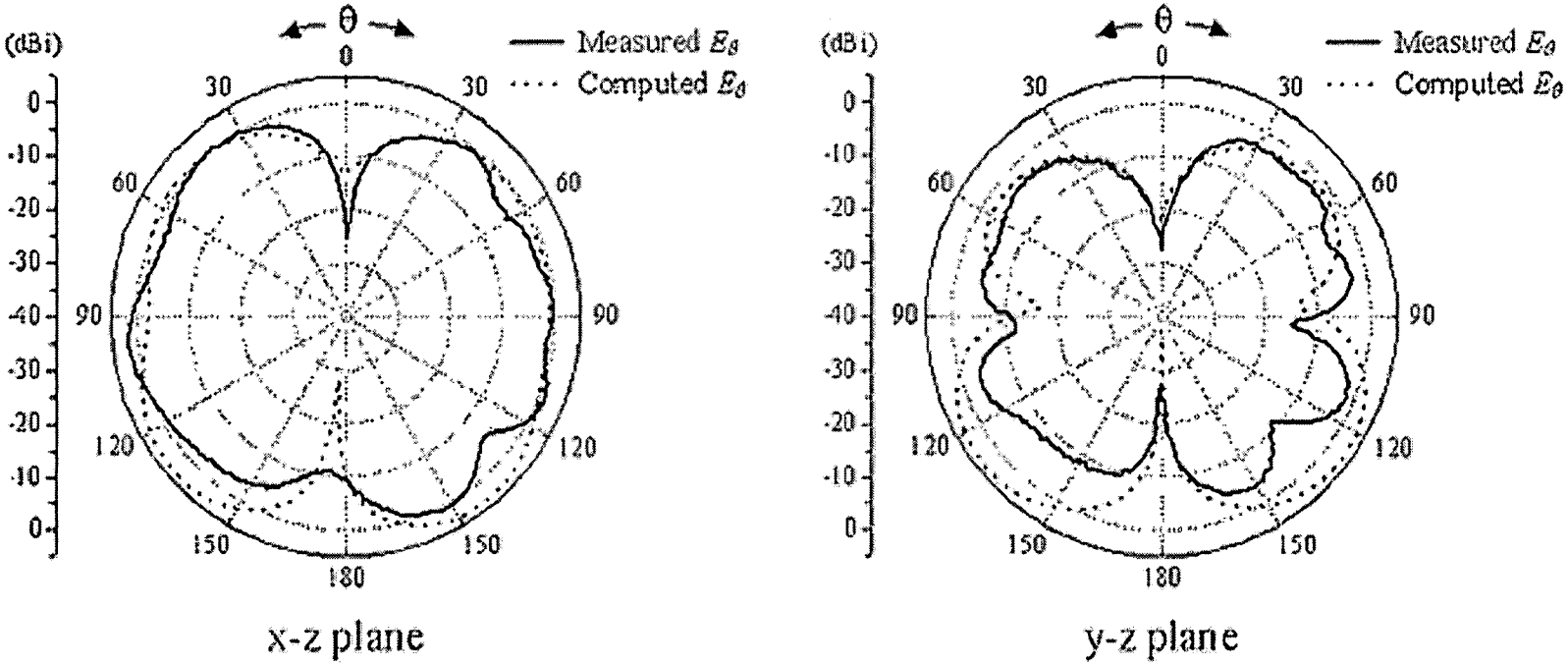
Figure 7C:
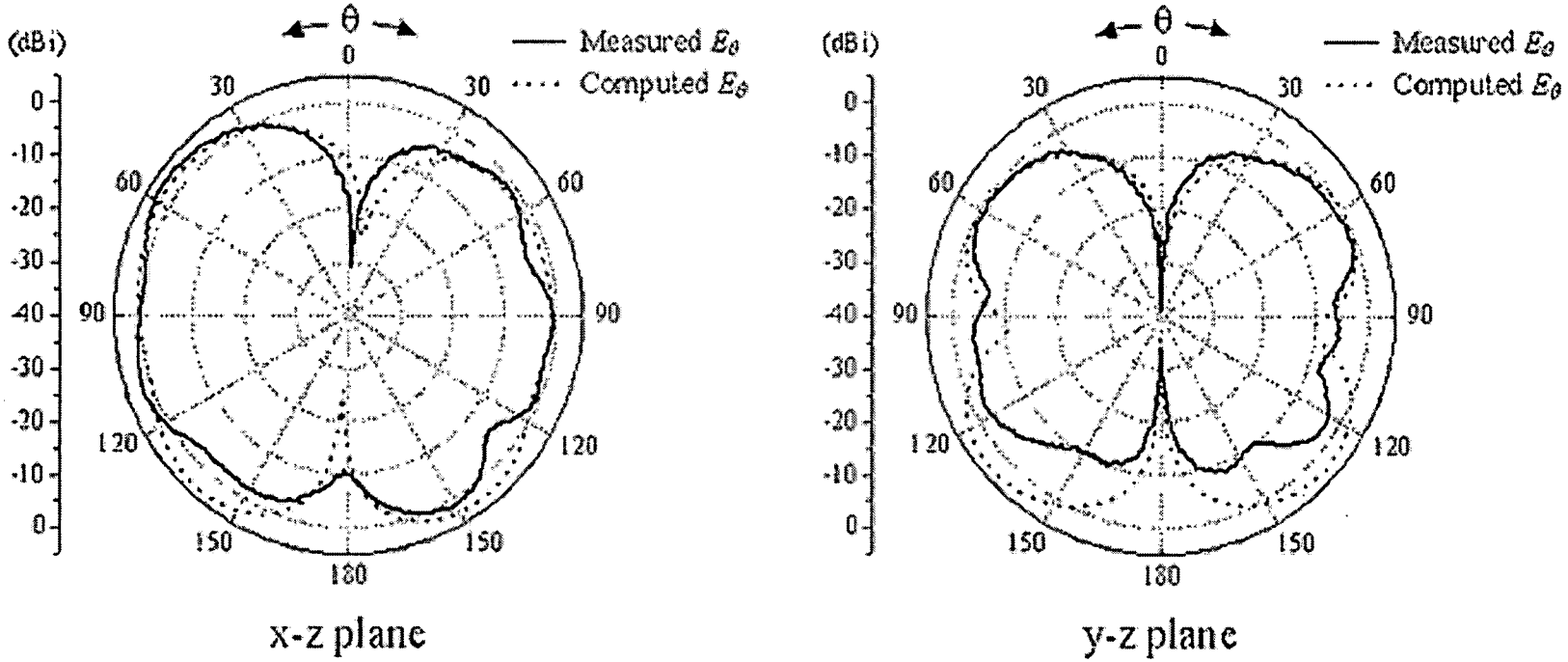

FIGS. 7A through 7C are graphs illustrating radiation patterns $E_\theta$ of an antenna within a bandwidth. In other words, FIG. 7A illustrates the radiation pattern $E_\theta$ at a frequency of 2.0 GHz, FIG. 7, illustrates the pattern $E_\theta$ at a frequency 2.3 GHz, and FIG. 7C illustrates the radiation pattern $E_\theta$ at a frequency 2.6 GHz.

The antenna has a monopole type radiation pattern in which a maximum radiation is performed in a specific direction but not in a direction of θ=0°. Describing the measured radiation pattern of the antenna, a radiation pattern similar to that of a conventional monopole antenna appears on an x-z plane, which is horizontal to a ground plane. However, a null occurs in a specific direction in a radiation pattern on a y-z plane and backward radiation toward the ground plane is increased.

Describing a gain in a forward direction of the antenna, the gain is about −6.9 dBi in a direction of about θ=45° at a frequency of 2.0 GHz, about −3.0 dBi in a direction of about θ=60° at a frequency of 2.3 GHz, or about −0.5 dBi in a direction of about θ=65° at a frequency of 2.6 GHz.

Also, the null on the y-z plane occurs in a direction of about θ=80° at the frequency of 2.0 GHz. When the frequency is increased to 2.3 GHz, the null moves toward a direction of about θ=92°. The radiation pattern is distorted on the y-z plane due to a return current that forms on the ground plane. A radiation is generated on the ground plane due to a flow of the return current. Thus, the radiation pattern of the antenna is distorted. As a result, the null occurs, and the radiation is increased toward the ground plane.

Figure 8A:
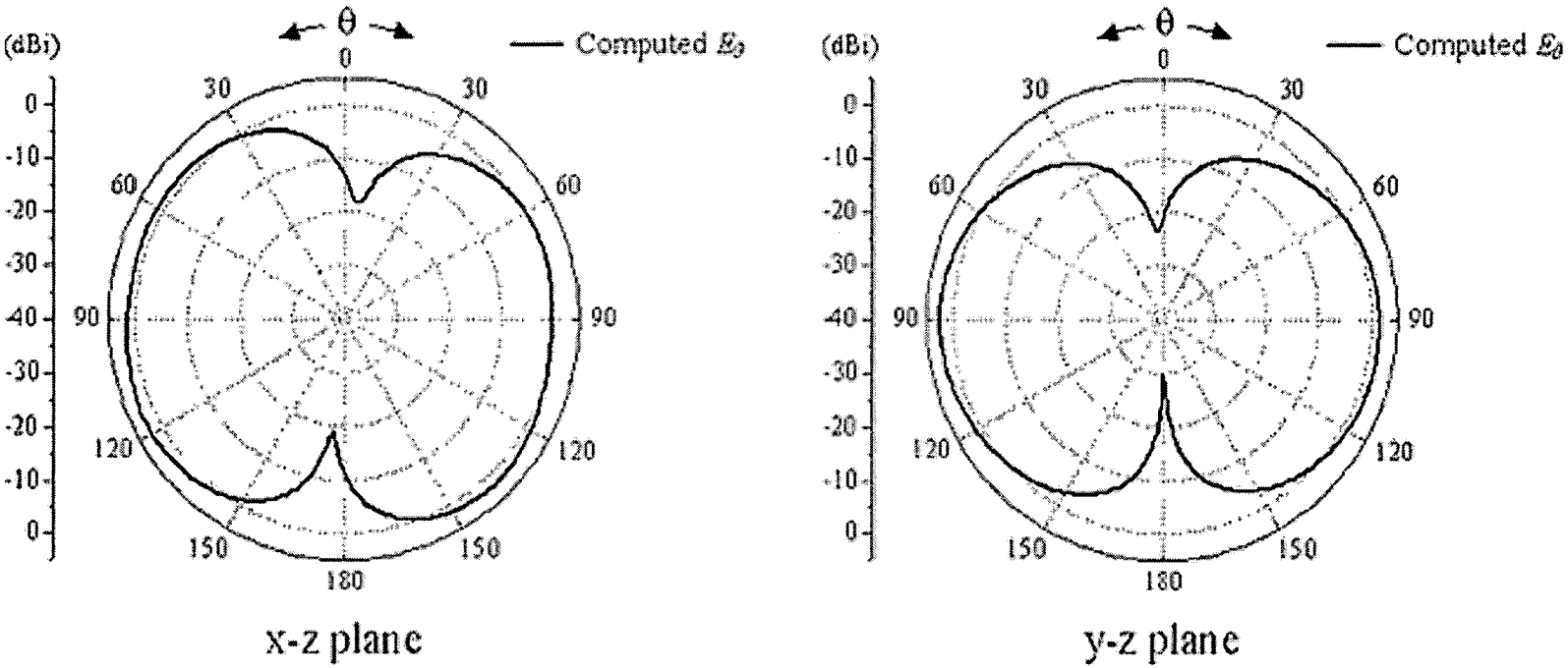
FIGS. 8A and 8B are graphs illustrating radiation patterns of an antenna with respect to a perpendicular length of a ground plane.
Figure 8B:
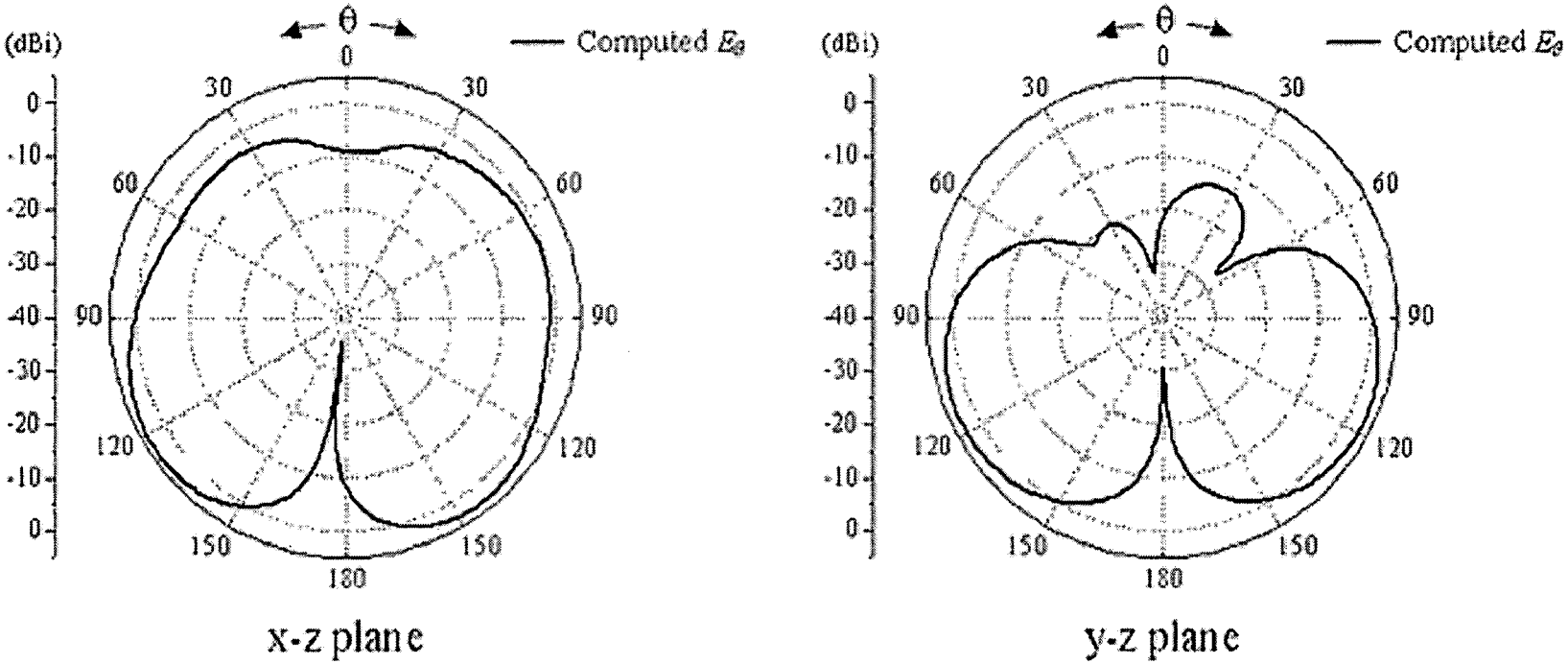

FIGS. 8A and 8B are graphs illustrating radiation patterns of an antenna with respect to a perpendicular length of a ground plane. To describe an effect of a radiation pattern with respect to the vertical length of the ground plane, variations in the radiation pattern $E_\theta$ with respect to the perpendicular length A of the ground plane were compared based on a frequency of 2.3 GHz. When the perpendicular length A is 30 mm, an electrical length of the perpendicular length A is about $0.234\lambda_0$ at a central frequency of 2.343 GHz based on a wavelength of a free space. When the perpendicular length A is 60 mm and 90 mm as shown in FIG. 7B, the electrical length is $0.468\lambda_0$ and $0.703\lambda_0$, respectively.

Referring to FIG. 8A, when the perpendicular length A is 30 mm, a high-quality monopole radiation pattern is generated on the x-z plane. When the perpendicular length A is increased to 60 mm, a backward radiation is increased so as to obtain a maximum gain of about 3.5 dBi in a direction of θ=127. Referring to FIG. 8B, when the perpendicular length A is 30 mm, a direction of a main beam of the antenna is θ=90°, and a gain is about 1.5 dBi. However, when the perpendicular length A is 60 mm, a null occurs in a direction of about θ=55°. Also, a gain of about 3.8 dBi shows in a direction of θ=120° direction, and thus the backward radiation is greatly generated.

Describing the radiation pattern at the perpendicular length A of 90 mm shown in FIG. 7B, the null moves in the direction of θ=90°. Thus, a position in which the null occurs moves downward with the increase in the perpendicular length. A distortion of the radiation pattern greatly shows on the y-z plane. This is because the radiation of the ground plane strongly shows in a y-axis direction perpendicular to the ground plane. Referring to the variation in the radiation pattern, an effect of a return current with respect to a length of the ground plane must be minimized in order to minimize the backward radiation.

However, in a case where an antenna is mounted in a mobile communication terminal or the like, a perpendicular length of a ground plane is about 90 mm longer than $0.25\lambda_0$. Although the mobile communication terminal divides and uses the ground plane using a multilayer substrate, the divided ground planes are connected to one another through a viahole. Thus, the antenna is affected by the perpendicular length of the entire substrate. Therefore, it is difficult to avoid the distortion of the radiation pattern occurring in the antenna. The distortion of the radiation pattern deteriorates the gain of the antenna of the terminal and thus deteriorates the quality of telephonic communication. Currently announced research suggests a method of connecting a passive load to a ground plane to reduce a distortion of a radiation pattern and a method of forming a notch on a ground plane to improve a radiation pattern. In this method, a flow of a return current varies on the ground plane to reduce a distortion of a radiation pattern caused by a radiation occurring on the ground plane. As a result, a gain of an antenna can be improved. However, announced studies on an effect of a radiation pattern of an antenna having a perpendicular ground plane have been performed with respect to a narrowband antenna structure using a general monopole having a length of $0.25\lambda_0$. Studies on an antenna having a broadband characteristic are unsatisfactory.

Accordingly, a small disc-loaded monopole antenna having a broadband characteristic by inserting symmetric slits into a ground plane to reduce a backward radiation so as to improve a gain characteristic will now be described.

Figure 9:
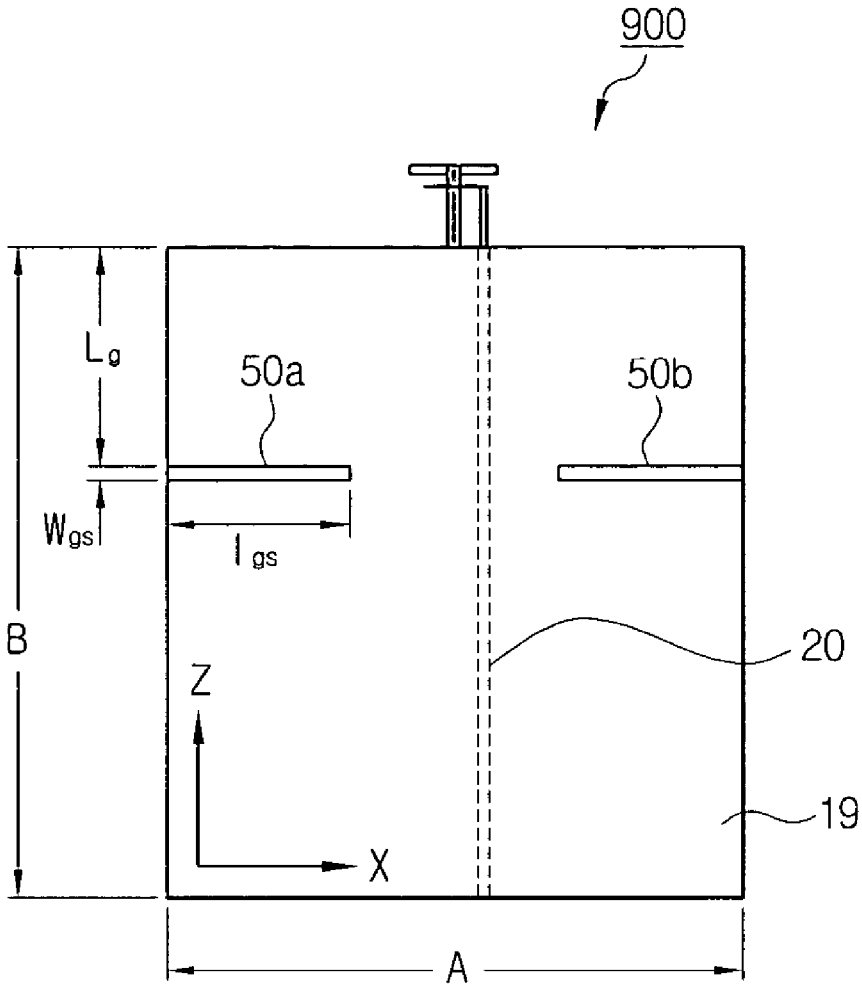
FIG. 9 is a view illustrating a structure of a small broadband monopole antenna having a perpendicular ground plane into which slits are inserted, with an electromagnetically coupled feed, according to another exemplary embodiment of the present invention.

FIG. 9 is a view illustrating a structure of a small broadband monopole antenna having an electromagnetic coupling feed in which slits are inserted into a perpendicular ground plane according to another exemplary embodiment of the present invention. To solve a distortion of a radiation pattern of an antenna 900, first and second slits 50*a* and 50*b* having rectangular shapes are symmetrically inserted at a predetermined perpendicular length $L_g$ from left and right upper portions of a perpendicular ground plane 19. Each of the first and second slits 50*a* and 50*b* may have length $l_{gs}$ of 26.5 mm and a width $w_{gs}$ of 2.5 mm, and the first and second slits 50*a* and 50*b* are symmetrically disposed beside both sides of the ground plane 19 on a z axis toward which the antenna is positioned. A horizontal length A of the perpendicular ground plane 19 may be 80.0 mm, a perpendicular length B of the perpendicular ground plane 19 may be 90.0 mm, and a perpendicular length $L_g$ from the left and right upper ends of the ground plane 19 to the first and second slits 50*a* and 50*b* may be 30.0 mm. A return current on the ground plane 19 is concentrated on the ground plane 19 above the first and second slits 50*a* and 50*b* due to the insertion of the first and second slits 50*a* and 50*b*. Thus, the return current is reduced under the first and second slits 50*a* and 50*b*.

Therefore, an effect of a radiation caused by a ground plane is reduced so as to reduce a backward radiation. Also, a distortion of the radiation caused by a null can be removed. Thus, the antenna forms the distribution of the current on the ground plane, as in when the perpendicular length A of the ground plane is 30 mm as shown in FIG. 7, and the characteristic of the radiation pattern is improved.

Figure 10:
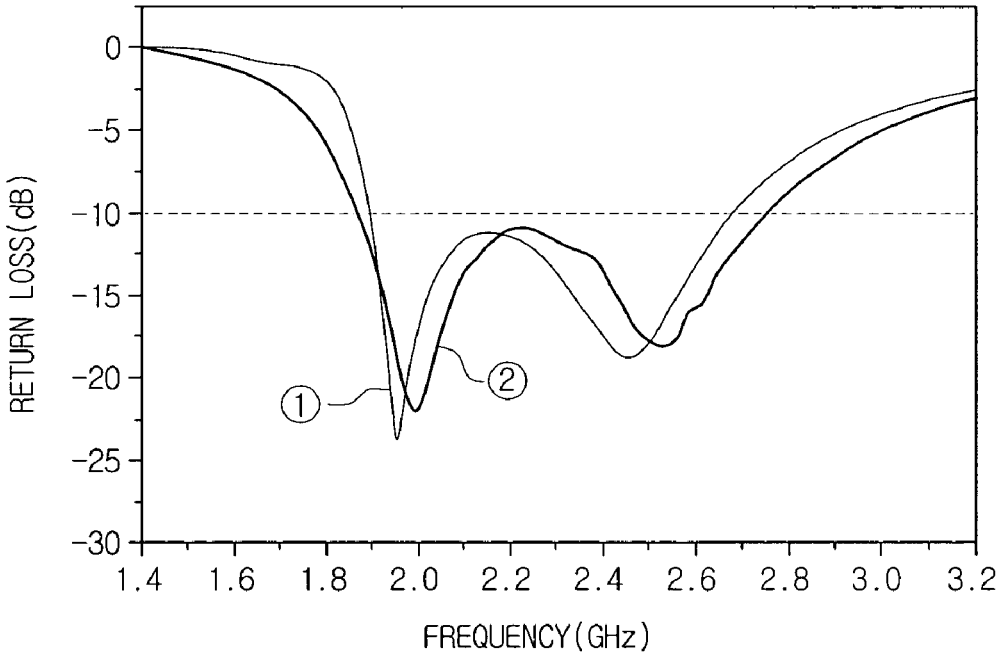
FIG. 10 is a graph illustrating a return loss of the small broadband monopole antenna shown in FIG. 9.

FIG. 10 is a graph illustrating a return loss of the antenna shown in FIG. 9. Referring to FIG. 10, a computed bandwidth (shown with a curve ①)) is 34.3% of a central frequency of 2.287 GHz from 1.894 GHz to 2.68 GHz. A measured bandwidth (shown with a curve ②) is about 37.6% of a central frequency of 2.313 GHz from 1.878 GHz to 2.748 GHz.

Compared to a measured result of an antenna having a general ground plane with no slits, when slits are inserted, a central frequency of a resonance bandwidth is increased by about 22 MHz, and the resonance bandwidth is increased by about 3.47%. Although slits are inserted into a ground plane, the slits do not greatly affect a return loss of the antenna. However, the return loss similarly shows.

Figure 11A:
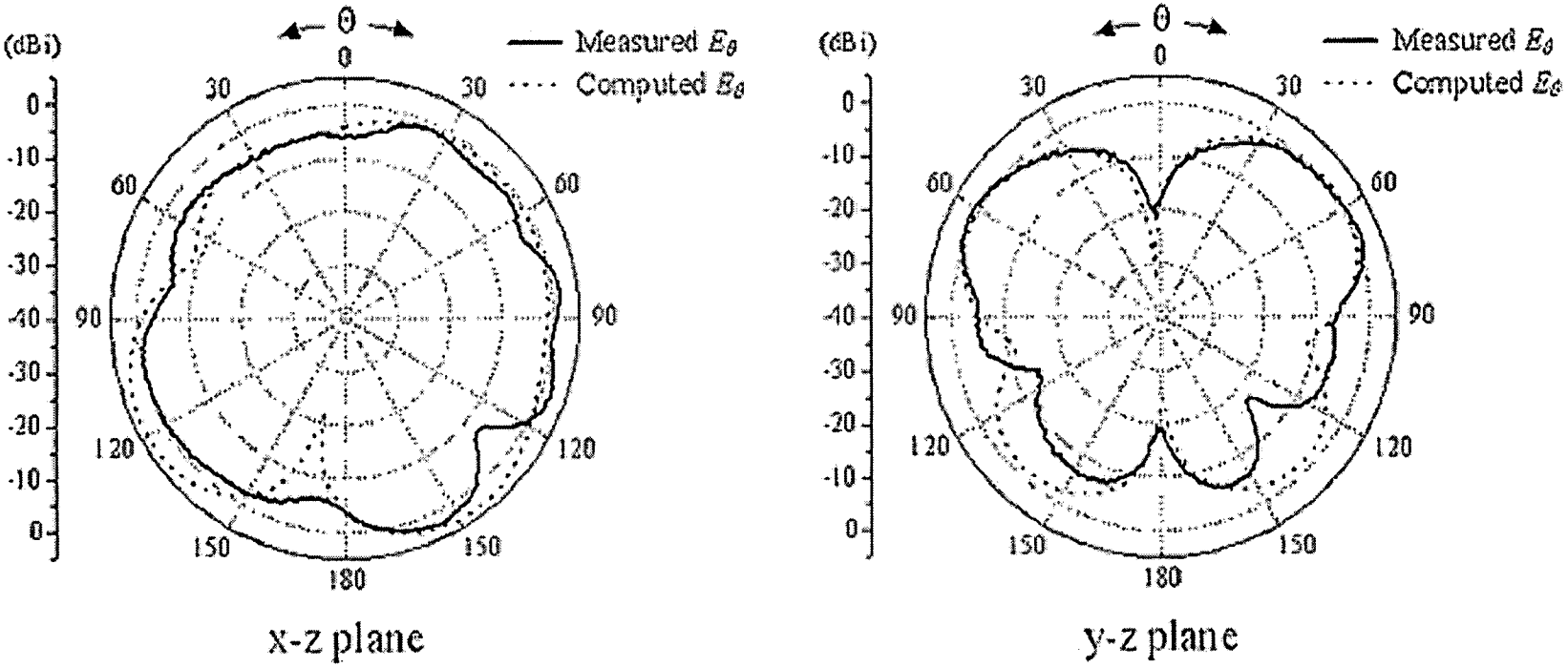
FIGS. 11A through 11C are views illustrating radiation patterns $E_\theta$ of the small broadband monopole antenna shown in FIG. 9.
Figure 11B:
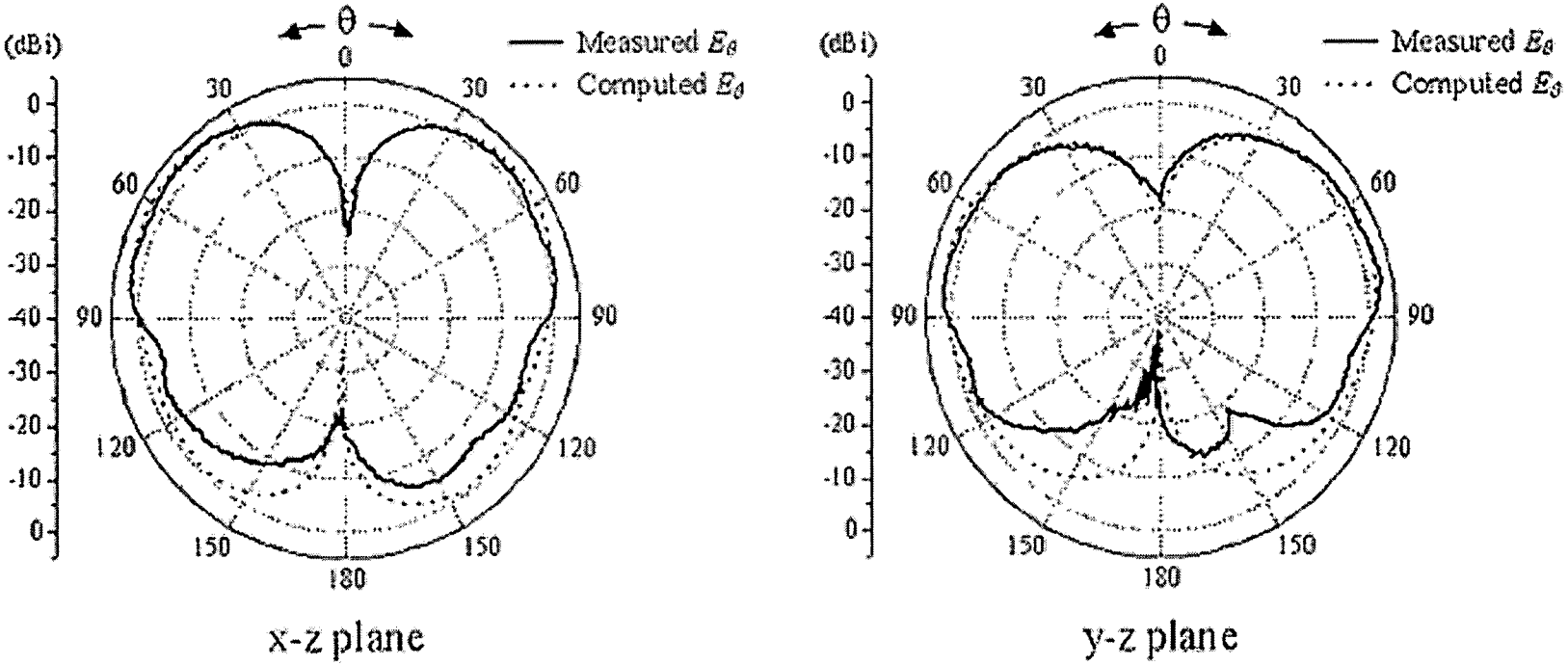
Figure 11C:
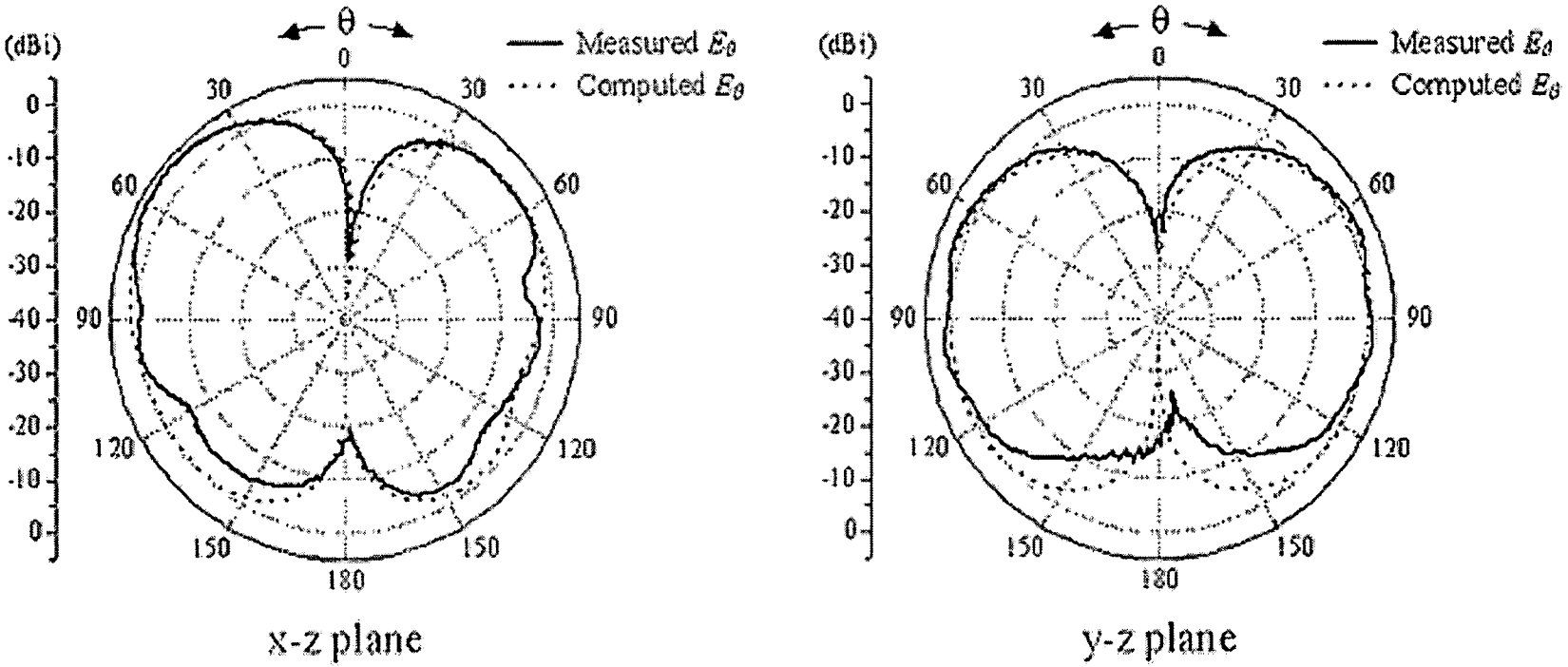

FIGS. 11A through 11C are views illustrating radiation patterns $E_\theta$ of the antenna shown in FIG. 9. Describing a gain measured in a direction along which a maximum radiation is achieved, with respect to a frequency on an x-z plane, the gain is 3.69 dBi in a direction of θ=45° at a frequency of 2.0 GHz, 2.54 dBi in a direction of θ=45° at a frequency of 2.3 GHz, and 3.86 dBi in a direction of θ=50 at a frequency of 2.6 GHz. Also, on a y-z plane, the gain is 1.4 dBi in a direction of θ=60° at a frequency of 2.0 GHz, 3.0 dBi in a direction of θ=80° at a frequency of 2.3 GHz, and 1.9 dBi in a direction of θ=70° at a frequency of 2.6 GHz. Also, a null occurring between θ=75° and θ=90° on the y-z plane disappears from the radiation pattern, and a backward radiation toward the ground plane is reduced. Comparing a radiation pattern of an antenna having a ground plane into which slits are inserted with a radiation pattern of an antenna having a general ground plane, radiation directed to the rear of the antenna is reduced by 3 dBi or more. Also, a gain is increased in the forward direction of the antenna to improve the characteristic of the antenna.

As described above, according to an exemplary embodiment of the present invention, a shorted square disc of an antenna can be electromagnetically coupled to a square folded strip line feed. Thus, the shorted square disc and the square folded line feed can respectively have independent resonance frequencies. Therefore, the antenna can vary design parameters of the shorted square disc and the square folded strip line feed to couple the resonance frequencies of the shorted square disc and the square folded strip line feed so as to obtain a wide bandwidth. Also, a perpendicular ground plane can produce a radiation due to an effect of a return current and thus distorts a radiation pattern of the antenna. Thus, rectangular slits can be inserted into the ground plane to reduce the distortion of the radiation pattern. The rectangular slits may be positioned at a distance of $0.25\lambda_0$ from an end of the ground plane and vary a distribution of the return current so as to reduce a backward radiation of the antenna. As a result, gain in a forward direction of the antenna can be improved.

An antenna having a perpendicular ground plane with no slits forms a bandwidth of about 34.13% of a central frequency of 2.291 GHz from 1.90 GHz to 2.682 GHz based on VSWR≦2. However, the antenna having the perpendicular ground plane with the slits forms a bandwidth of about 37.6% of a central frequency 2.313 GHz from 1.878 GHz to 2.748 GHz. Thus, the antenna having the perpendicular ground plane with the slits has a bandwidth that is about 2.6 times wider than a general disc-loaded monopole antenna having the same physical size. The antenna has an omnidirectional monopole radiation pattern and can reduce a backward radiation by 3 dBi or more through the slits inserted into the perpendicular ground plane. Also, a gain of the antenna toward a maximum radiation is about 2.6 dBi within the bandwidth.

The foregoing embodiments are merely exemplary and are not to be construed as limiting the present invention. The present teaching can be readily applied to other types of apparatuses. Also, the description of the exemplary embodiments of the present invention is intended to be illustrative, and not to limit the scope of the claims, and many alternatives, modifications, and variations will be apparent to those skilled in the art.

What is claimed is:

1. A monopole antenna comprising:

a shorted patch;

a strip line probe including a predetermined length that is electromagnetically coupled to the shorted patch; and a ground plane that is perpendicular to the shorted patch and the strip line probe, wherein a serial resonance of the strip line probe is coupled to a parallel resonance of the shorted patch.

2. The monopole antenna of claim 1, further comprising:

a first dielectric substrate disposed between the shorted patch and the strip line probe.

3. The monopole antenna of claim 1, wherein the strip line probe is fed by a microstrip line of a predetermined diameter that is disposed on a first surface of a second dielectric substrate, and the shorted patch is coupled to an upper end of the ground plane, which is disposed on a second surface of the second dielectric substrate that is opposed to the first surface, through a shorted pin, so as to position the ground plane perpendicular to the strip line probe and the shorted patch.

4. The monopole antenna of claim 3, wherein the second dielectric substrate is perpendicular to the strip line probe and the shorted patch.

5. The monopole antenna of claim 3, further comprising:

rectangular first and second slits that are symmetrically disposed at a predetermined perpendicular distance from left and right upper ends, respectively, of the ground plane, which is perpendicular to the strip line probe and the shorted patch.

6. The monopole antenna of claim 5, wherein the first and second slits vary a flow of a return current on the ground plane so as to minimize an effect of a radiation of the ground plane.

7. The monopole antenna of claim 5, wherein the first and second slits reduce a backward radiation toward the ground plane so as to improve a gain in a forward direction of the monopole antenna.

8. The monopole antenna of claim 1, wherein:

the shorted patch operates as a monopole having a capacitance component; and the strip feed line probe operates as a monopole having an inductance component, wherein the capacitance component of the shorted patch is compensated by the inductance component of the strip feed line probe so as to expand frequency bandwidth of the monopole antenna.

9. The monopole antenna of claim 1, wherein a resonance of the strip line probe and a resonance of the shorted patch are produced at different frequencies so as to generate a dual band.

10. The monopole antenna of claim 1, wherein the strip line probe has one of a spiral shape, a helix shape, and a folded shape that is realized by folding a strip line.

11. The monopole antenna of claim 1, further comprising:

rectangular first and second slits that are symmetrically disposed at a predetermined perpendicular distance from left and right upper ends, respectively, of the ground plane, which is perpendicular to the strip line probe and the shorted patch.

12. The monopole antenna of claim 1, wherein the shorted patch is disposed parallel to the strip line probe.

* * * * *